US005862825A

United States Patent [19]

Leonard

[11] Patent Number: 5,862,825

[45] Date of Patent: Jan. 26, 1999

[54] WALKER

[75] Inventor: Fred Leonard, Tenafly, N.J.

[73] Assignee: Graham-Field, Inc., Hauppauge, N.Y.

[21] Appl. No.: 907,287

[22] Filed: Aug. 6, 1997

[51] Int. Cl.[6] ..... A61H 3/00

[52] U.S. Cl. ..... 135/67; 135/74; 297/6; 482/66; 16/344; 280/87.021

[58] Field of Search ..... 135/66, 67–69, 135/74, 75; 297/59, 52, 16.1, 47, 42, 6; 280/87.021, 87.041; 482/66, 68, 69; 403/91, 92, 110; 16/371, 344

[56] References Cited

U.S. PATENT DOCUMENTS

| | | | |
|---|---|---|---|
| 3,688,789 | 9/1972 | Bunch | 135/67 |
| 3,690,652 | 9/1972 | Schneider | 135/67 |
| 4,640,301 | 2/1987 | Battiston, Sr. et al. | 135/74 X |
| 4,958,842 | 9/1990 | Chang | 280/87.041 |
| 5,201,333 | 4/1993 | Shalmon et al. | 135/67 |
| 5,273,063 | 12/1993 | Farr et al. | 135/66 |
| 5,402,811 | 4/1995 | Weng | 135/69 X |
| 5,433,235 | 7/1995 | Miric et al. | 135/67 |
| 5,529,425 | 6/1996 | Spies et al. | 135/74 X |
| 5,579,793 | 12/1996 | Gajewski et al. | 135/67 |
| 5,580,316 | 12/1996 | Hill et al. | 16/344 X |

FOREIGN PATENT DOCUMENTS

| | | | |
|---|---|---|---|
| 586911 | 1/1978 | Russian Federation | 135/67 |

*Primary Examiner*—Winnie S. Yip
*Attorney, Agent, or Firm*—Bauer & Schaffer

[57] ABSTRACT

A collapsible walker that includes a front frame, a pair of side frames, and a pair of levers. The front frame has a pair of skewed surfaces. The pair of side frames are hingedly attached to the front frame and are parallel thereto when the collapsible walker is in the closed position and are perpendicular thereto when the collapsible walker is in the open position. The pair of side frames have notches therein with skewed surfaces, with the pair of skewed surfaces of the front frame being vertically movable in the notches. The skewed surfaces of the pair of side frames move relative to the pair of skewed surfaces of the front frame as the collapsible walker is achieving the open position, until such time as it achieves the open position in which the pair of skewed surfaces of the front frame and drop down in the notches and mate with, and abut against, the skewed surfaces therein so as to prevent relative rotation therebetween and further rotation of the pair of side frames in both directions. The pair of levers are pivotally mounted to the pair of side frames and selectively lift the pair of skewed surfaces of the front frame out of engagement with the skewed surfaces of the pair of side frames, and into the notches so as free the pair of side frames to pivot inwardly and allow the collapsible walker to achieve the closed position.

17 Claims, 8 Drawing Sheets

WALKER

BACKGROUND OF THE INVENTION

The present invention relates to a walker. More particularly, the present invention relates to a collapsible walker having an open position defined by an open rear adapted to have a user enter and leave therethrough and being lightweight with a strength to weight ratio sufficient to assist a user in walking when the collapsible walker is in the open locked position, with the open position being automatically maintained when the collapsible walker achieves the open position, and further having a closed position where the collapsible walker is collapsed to reduce required storage space.

DESCRIPTION OF THE PRIOR ART

Many of the aged or infirmed have difficulty walking because they have weak legs or poor balance. In order to help these people remain independently mobile, various walking devices have been developed that allow the user to support his weight at least partially with his arms. The open walking frame or walker is such a device.

Walkers generally consist of four legs attached by some form of square frame with at least one side open so that the user can stand within the four legs. The frame has handles so the user can pick up the walker, set it in front of him, and lean on it as he walks forward. In this way, the user can support some of his weight with his arms and shoulders. Further, the user can balance his weight more easily by shifting his weight to the different sides of the walker.

Walkers have been developed that fold into small space so that they can be more easily stored when not in use. These types of walkers are comprised of three frames, one in the front and one on each side, with the user stepping into the walker from the rear. When the walker is not being used, the side frames can each be rotated onto the front frame of the walker to reduce storage space. The side frames are locked in the open position by various mechanisms.

One such type of folding walker employs a brace extending from a rear leg to a front leg of the side frame. The locking mechanism consists of a sliding pad that is pinned onto the side frame at a single point on the bottom of the brace. The sliding pad is slidingly mounted onto the front frame by a front pin, which moves along in a notch in the sliding pad as the side frame is opened and closed, while a detent is mounted on the front frame. As the side frame is opened, the detent pin slips into a hole on the sliding pad and thereby prevents the pad from sliding about the front pin. Thus, the side frame is prevented from opening or closing by the sliding pad. To unlock the sliding pad, the user must reach from the handle on the side frame to a small tab on the sliding pad at the front frame to depress the detent pin, with the tab being located in front of the front foot of the walker.

Another such type of folding walker employs a notched rod that is pinned at a single point onto the side frame at the bottom of a brace on the side frame. The rod fits within a spring-biased housing that is mounted on the front frame. When the side frame is opened to the proper position, the housing latches onto the notch in the rod, keeping the rod from moving and thereby preventing any further rotation by the side frame. To fold the walker, the user must reach from the handle on the side frame to the housing on the front frame, depress it so as to release the rod, and simultaneously close the side frame.

Other such types of folding walkers have locking means consisting of telescoping rods attached to the front and side frames or detents mounted on the legs of the walker that prevent the legs from rotating.

SUMMARY OF THE INVENTION

Accordingly, an object of the present invention is to provide a collapsible walker that overcomes the disadvantages of the prior art.

Another object of the present invention is to provide a collapsible walker that is simple and inexpensive to manufacture.

Still another object of the present invention is to provide a collapsible walker that can be manufactured in colors at no additional cost.

Briefly stated, yet another object of the present invention is to provide a collapsible walker that includes a plastic front frame, a pair of side plastic frames, and release levers. The front frame has a pair of skewed surfaces. The pair of side frames are hingedly attached to the front frame and are parallel thereto when the collapsible walker is in the closed position so as to reduce the required storage space and are perpendicular thereto when the collapsible walker is in the open position so as to assist the user in walking. The pair of side frames have molded notches therein with skewed surfaces in bottoms thereof, with the pair of skewed surfaces of the front frame being vertically movable in the notches. The skewed surfaces of the pair of side frames move relative to the pair of skewed surfaces of the front frame as the collapsible walker is achieving the open position, until such time as the collapsible walker achieves the open position in which the pair of skewed surfaces of the front frame drop down in the notches and mate with, and abut against, the skewed surfaces therein so as to prevent relative rotation therebetween and further rotation of the pair of side frames in both directions so as to maintain the collapsible walker in the open position. The pair of levers are pivotally mounted to the pair of side frames and selectively lift the pair of skewed surfaces of the front frame out of engagement with the skew surfaces of the pair of side frames, and into the notches so as to free the pair of side frames to pivot inwardly and allow the collapsible walker to achieve the closed position.

The novel features which are considered characteristic of the present invention are set forth in the appended claims. The invention itself, however, as to its material, construction and method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

DETAILED DESCRIPTION OF THE PREFERRED EMBODIMENT

Figure 1:
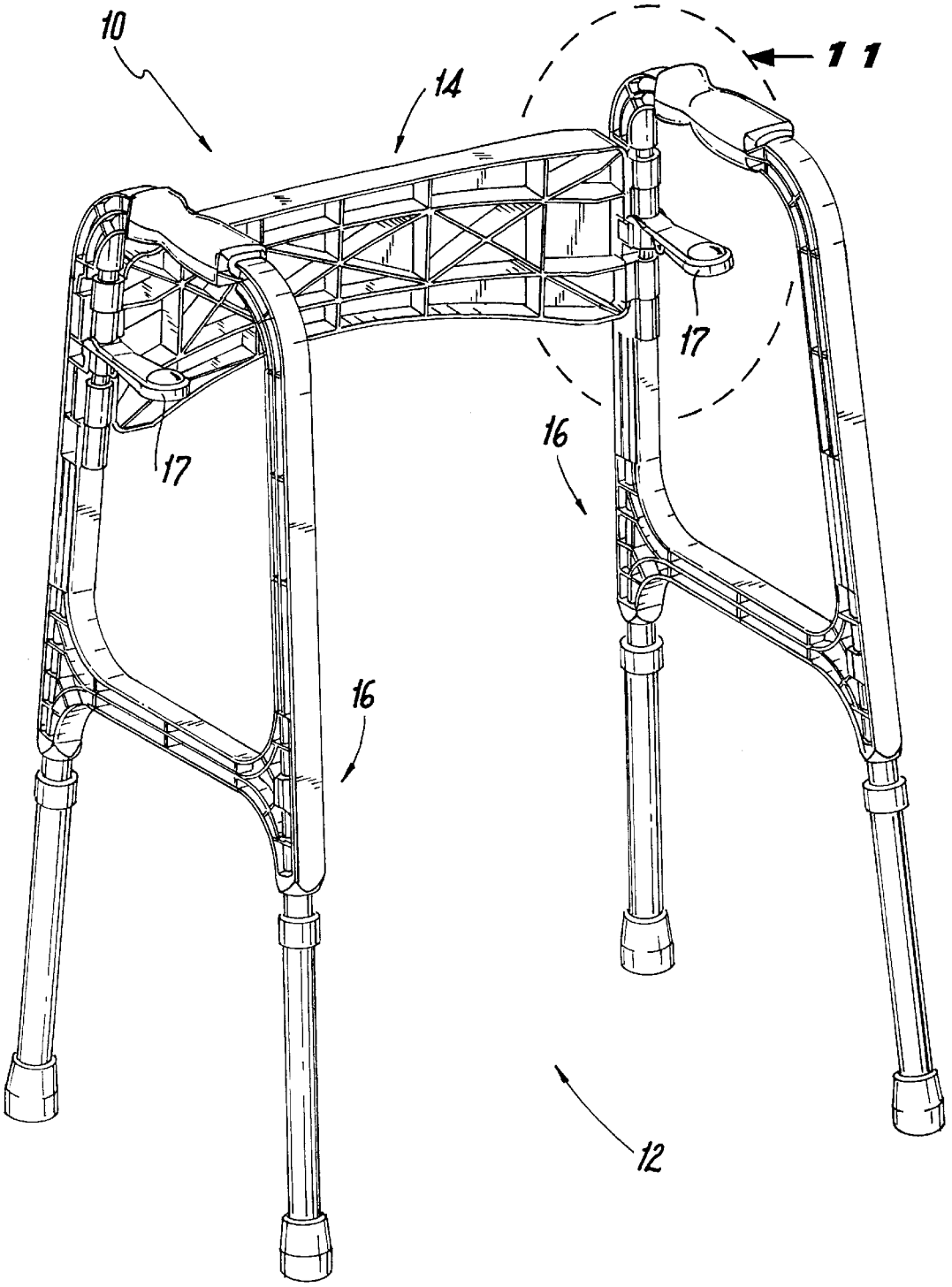
FIG. 1 is a rear diagrammatic perspective view of the present invention in the open position and ready for use.

Referring now to the figures in which like numerals indicate like parts, and particularly to FIG. 1, the collapsible walker of the present invention is shown generally at 10 in an open position and defining an open rear 12 that is adapted to have a user enter and leave therethrough.

The collapsible walker 10 is lightweight and has a strength to weight ratio sufficient to assist the user in walking when it is in the open position, which is automatically maintained when it achieves the open position, as will be discussed further infra.

The collapsible walker 10 includes a front frame 14 that is adapted to be disposed in front of the user when it is in the open position, a pair of side frames 16 that are hingedly attached to the front frame 14, and perpendicular thereto, and adapted to be disposed at the sides of, and support, the user when it is in the open position so as to assist the user in walking, and a pair of levers 17 that are pivotally mounted to the pair of side frames 16 and selectively release the pair of side frames 16 from the open position so as to allow the collapsible walker 10 to achieve a closed position.

Figure 2:
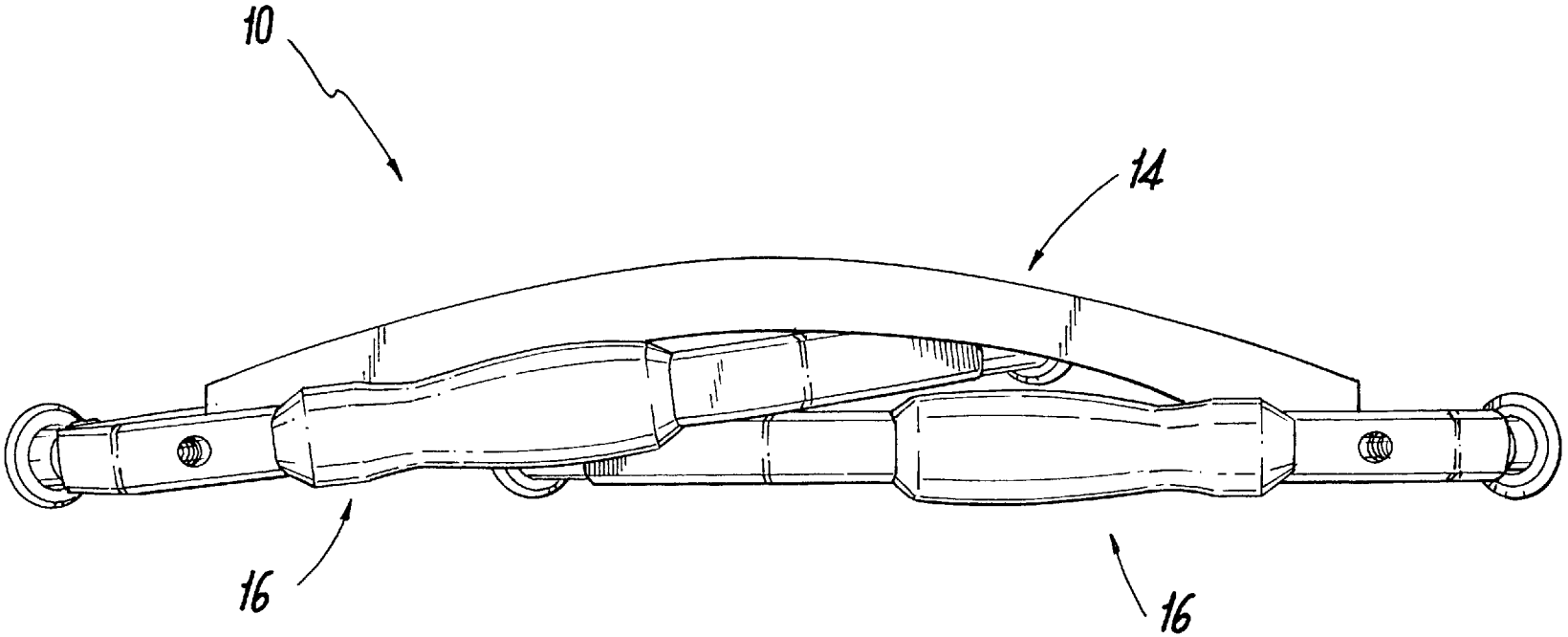
FIG. 2 is a diagrammatic top perspective view of the present invention in the closed position and ready for storage.

As shown in FIG. 2, the collapsible walker 10 is in the closed position, in which it is collapsed with the pair of side frames 16 being parallel to the front frame 14 so as to reduce the require storage space.

Figure 3:
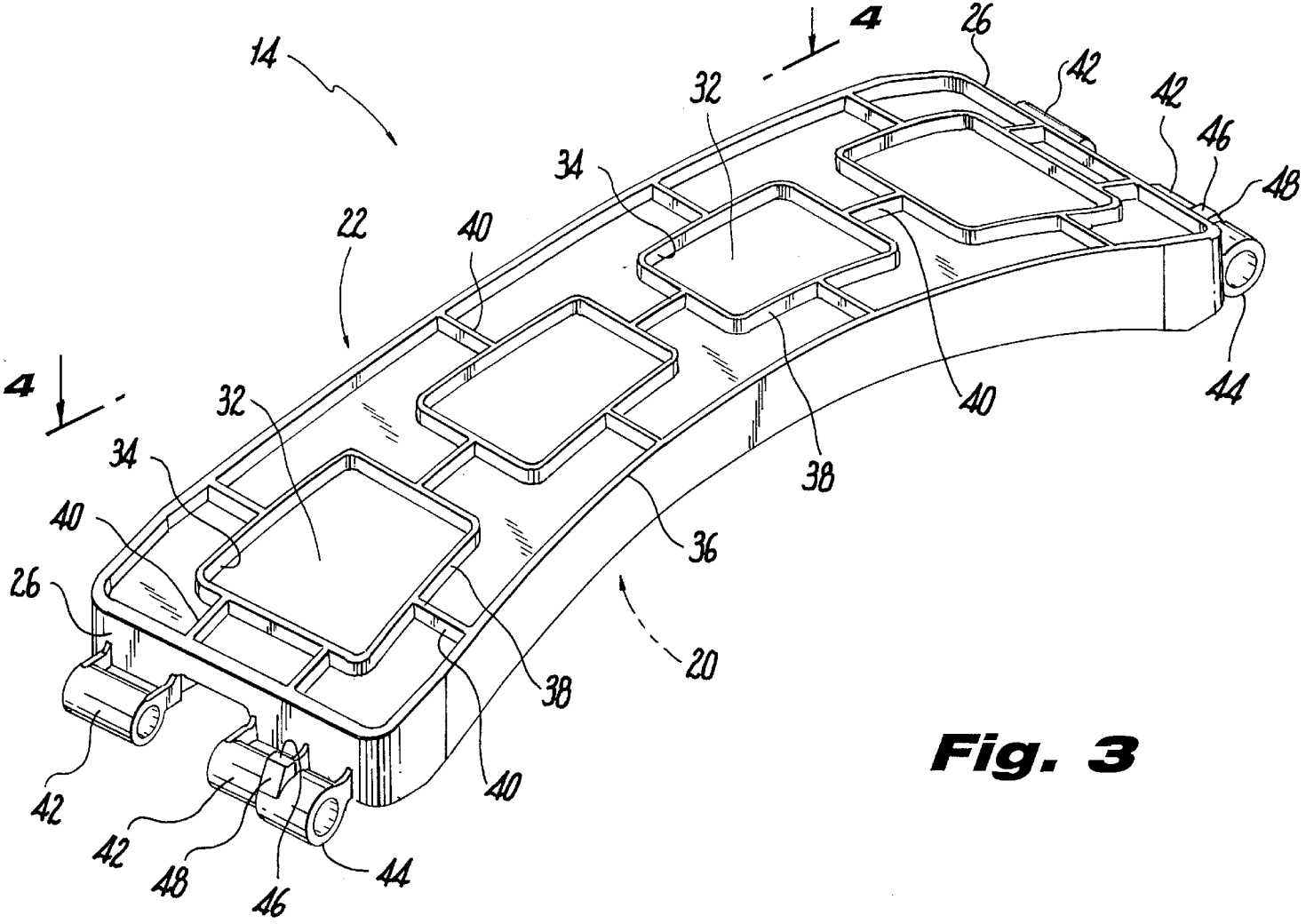
FIG. 3 is an enlarged diagrammatic top perspective view of a front frame of the present invention shown in FIG. 1 and FIG. 2.
Figure 4:
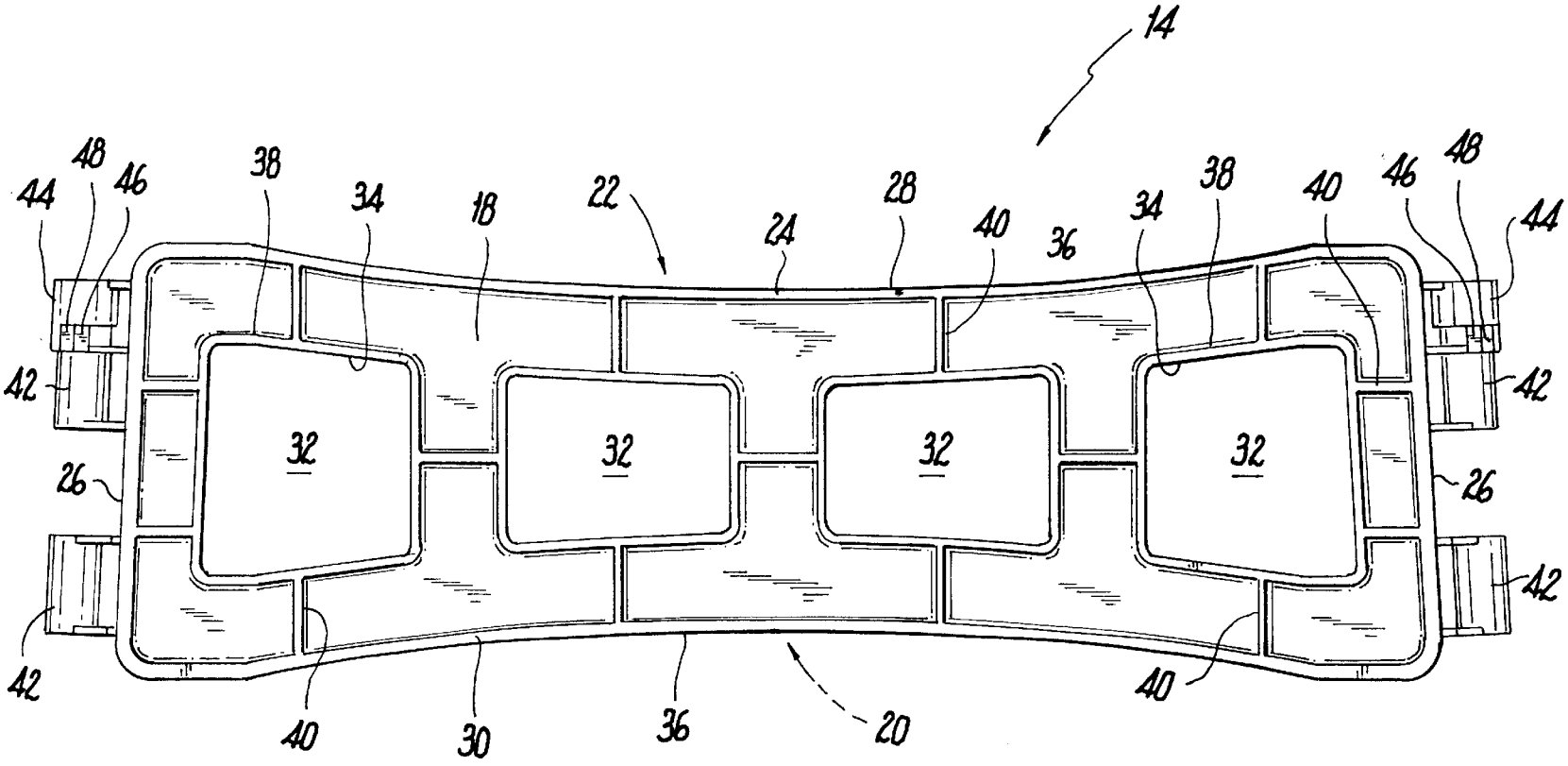
FIG. 4 is a diagrammatic front elevational view of the front frame taken generally in the direction of Arrow 4 in FIG. 3.

The configuration of the front frame 14 can best be seen in FIG. 3 and FIG. 4, and as such will be discussed with reference thereto.

The front frame 14 includes a sheet 18 that is vertically-oriented, planar, thin, and substantially rectangular-shaped. The sheet 18 has a back face 20 that is slightly concave and adapted to face the user when the collapsible walker 10 is in the open position, a front face 22 that is slightly convex and disposed in front of the back face 20, and a periphery 24 formed by a pair of end edges 26, an upper edge 28 that is slightly concave and longer than each end edge of the pair of end edges 26, and a lower edge 30 that is slightly concave and disposed below the upper edge 28 and is longer than each end edge of the pair of end edges 26.

The sheet 18 further has a plurality of throughbores 32 that extend therethrough from the front face 22 thereof to the back face 20 thereof, and which are quadrilateral, aligned, and spaced-apart, and defined by peripheries 34.

The front frame 14 further includes a peripheral flange 36 that is slender and integrally formed with, and extends continuously around, the periphery 24, and slightly perpendicularly outwardly from both the front face 22 and the back face 20 so as to increase the strength to weight ratio and prevent deformation of, and premature failure of, the front frame 14, since the front frame 14 is lightweight plastic.

The front frame 14 further includes a plurality of interior flanges 38, each of which is slender and integrally formed with and extends continuously around a respective periphery of the peripheries 34 of the plurality of throughbores 32, and slightly perpendicularly outwardly from both the front face 22 and the back face 20 so as to further increase the strength to weight ratio and provide further structural strength to further prevent the deformation of, and the premature failure, of the front frame 14, since the front frame 14 is lightweight reinforced polypropylene plastic.

The front frame 14 further includes a plurality of connecting flanges 40 that are slender and integrally formed with, and connect, the plurality of interior flanges 38 to each other and to the peripheral flange 36, and extend slightly perpendicularly outwardly from both the front face 22 and the back face 20 so as to still further increase the strength to weight ratio and provide still further structural strength to still further prevent the deformation of, and the premature failure of, the front frame 14, since the front frame 14 is lightweight reinforced polypropylene plastic.

The front frame 14 further includes two pair of molded hinge barrels 42, each pair of which is vertically-aligned, integrally formed with, and extends from, the peripheral flange 36, at a respective end edge of the pair of end edges 26.

Each uppermost hinge barrel of the two pair of hinge barrels 42 is widened at its top to form a widened portion 44 that has extending perpendicularly forwardly therefrom, and integral therewith, a projection 46 that is horizontally-oriented and substantially right-triangular-shaped, with its hypothenuse extending from the widened portion 44 forwardly inwardly towards the front face 22 and forming a skewed surface 48 that is horizontally-oriented. The widened top portion 44 is widened to better adsorb the load on the projection 46 when the collapsible walker 10 is in the open position and being used.

Figure 5:
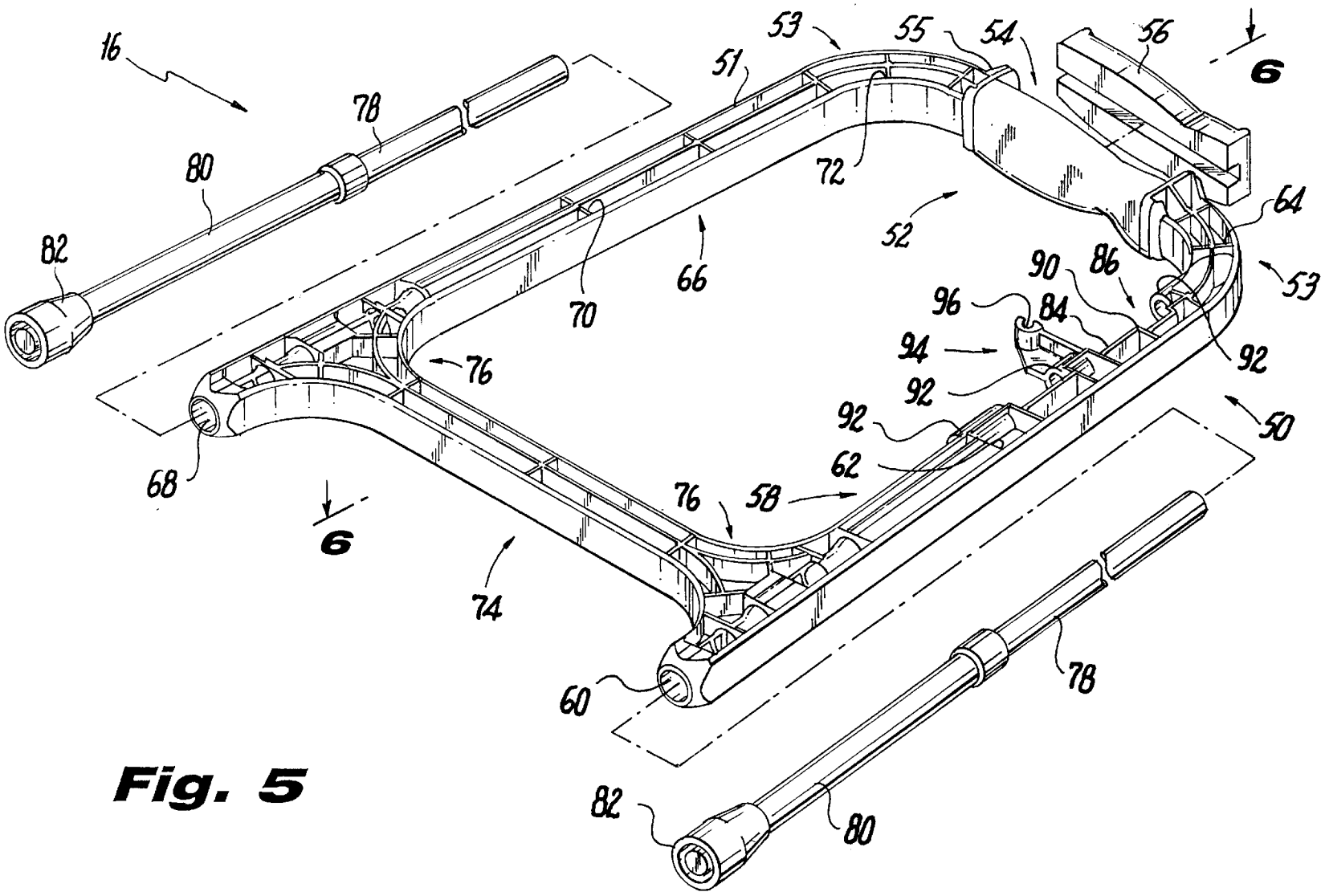
FIG. 5 is an enlarged diagrammatic front perspective view of each side frame of a pair of side frames of the present invention shown in FIG. 1 and FIG. 2.
Figure 6:
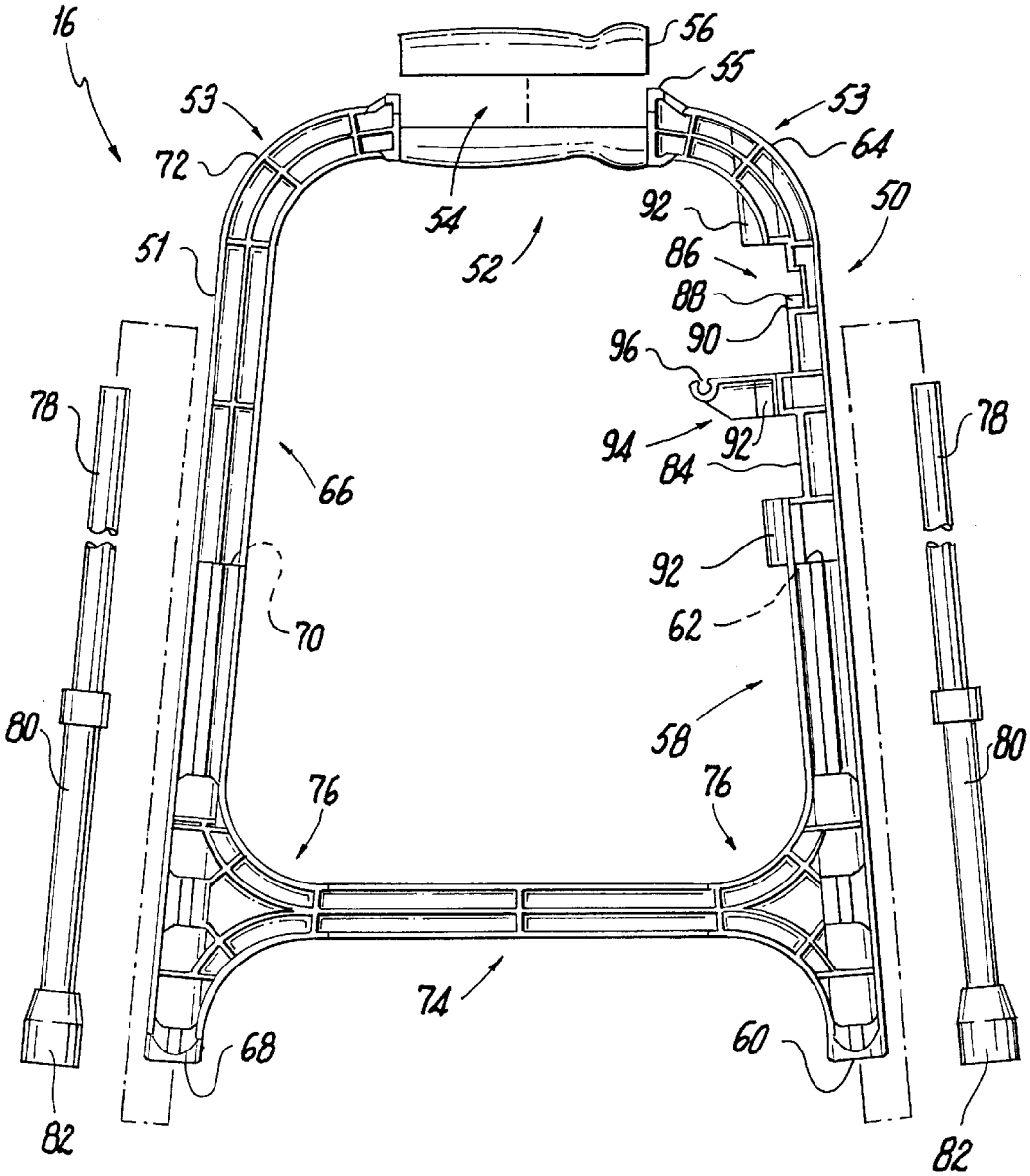
FIG. 6 is a diagrammatic front elevational view of each side frame of the pair of side frames taken generally in the direction of Arrow 6 in FIG. 5.
Figure 7:
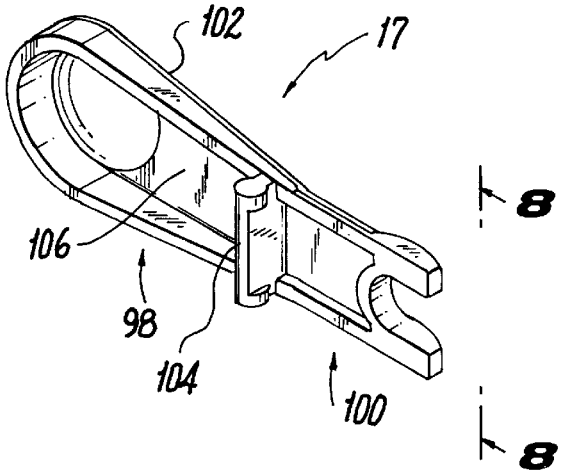
FIG. 7 is a diagrammatic bottom perspective view of each lever of a pair of levers of the present invention shown in FIG. 1.
Figure 8:
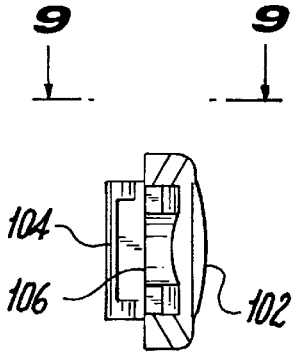
FIG. 8 is a diagrammatic end elevational view of each lever of the pair of levers taken generally in the direction of Arrow 8 in FIG. 7.
Figure 9:
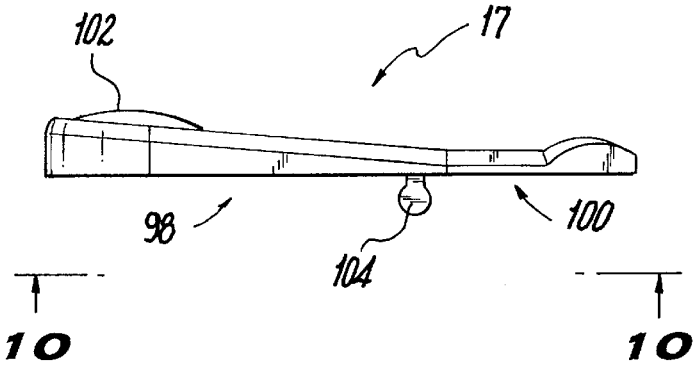
FIG. 9 is a diagrammatic side elevational view of each lever of the pair of levers taken generally in the direction of Arrow 9 in FIG. 8.
Figure 10:
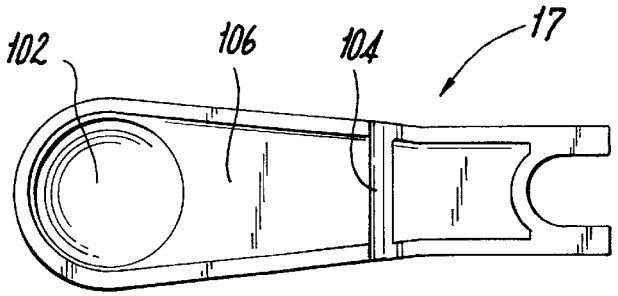
FIG. 10 is a diagrammatic bottom plan view of each lever of the pair of levers taken generally in the direction of Arrow 10 in FIG. 9.

The configuration of each side frame of the pair of side frames 16 can best be seen in FIG. 5 and FIG. 6, and as such will be discussed with reference thereto.

Each side frame of the pair of side frames 16 includes a one-piece sub-frame 50 which is vertically-oriented, substantially A-shaped, and formed of lightweight plastic with flanges 51 to further increase the strength to weight ratio.

The sub-frame 50 includes an upper cross member 52 that is slender, elongated, and horizontally-oriented, and has a pair of ends 53 and a recess 54 in its top face. Set within the recess 54 and held firmly between the ends 53 is a sub-handle 55 on which a premolded, contoured hand grip 56 is secured. The ends 53, the recess 54 and sub-handle 55 are provided with cooperating detents and recesses to removably hold the sub-handle 55 and hand grip 56 firmly when gripped by the user when walking. The premolded grip 56 will be available in multidurometer rubber for patient comfort and is advantageously made so as to snap onto the sub-handle 55. Thus, the grip may be selected to satisfy the user's physical as well as aesthetic needs.

The sub-frame 50 further includes a front leg 58 that has a hollow bottom 60 with a stop 62 therein, and is slender, elongated, and extends slightly forwardly downwardly from, and is integrally formed at its top 64 to, a forwardmost end of the pair of ends 53 of the upper cross member 52.

The sub-frame 50 further includes a rear leg 66 that has a hollow bottom 68 with a stop 70 therein, and is slender, elongated, and extends slightly rearwardly downwardly from, and is integrally formed at its top 72 to, a rearmost end of the pair of ends 53 of the upper cross member 52, and is disposed in back of, and coplanarly with, the front leg 58.

The sub-frame 50 further includes a lower cross member 74 that is horizontally-oriented, slender, and elongated, and disposed below, and parallel to, the upper cross member 52. The lower cross member 74 is integrally formed with, and is connected at its ends 76 to, the front leg 58 and to the back leg 66, at an elevation just above their hollow bottoms 60 and 68, and forms with the front leg 58 of the sub-frame 50, the back leg 66 of the sub-frame 50, and the upper cross member 52 of the sub-frame 50 a quadrilateral.

Each of the front leg 58 and the rear leg 66 contains an upper rod element 78 that is tubular and extends collinearly from the stops 62 and 70, respectively, outwardly through the hollow bottoms 60 and 68, respectively. A lower rod element extension 80 extends coaxially and telescopically from the upper rod element part 78 so as to be height adjustable, and terminates in a resilient tip 82 for better traction. The upper rod element 78 is molded and fixed in respective legs of the side frame to provide support for the legs as well as a firm support for the rod extensions.

The front leg 58 further has an inner face 84 that faces the rear leg 66, in which a notch 86 is disposed slightly below the top 64 thereof. The notch 86 is vertically-oriented and has a skewed surface 88 in its bottom 90 that is horizontally-oriented.

The inner face 84 further has three hinge barrels 92 that are vertically-aligned, with an uppermost hinge barrel thereof and an intermediate hinge barrel thereof straddling the notch 86 therebetween. The uppermost hinge barrel is disposed at the top 64 of the front leg 58 and a lowermost hinge barrel is disposed between the intermediate hinge barrel and the lower cross member 74.

The inner face 84 further has an arm 94 that is perpendicular to, and integral with, the intermediate hinge barrel, and extends towards the back leg 66 to a distance past the three hinge barrels 92, and terminates in a transverse resilient recess 96 that is upwardly opening.

The configuration of each lever of the pair of levers 17 can best be seen in FIGS. 7–10 and as such will be discussed with reference thereto.

Each lever of the pair of levers 17 is lightweight plastic and has a long portion 98 and a short portion 100 that is integrally formed with, and shorter than, the long portion 98 and is bifurcated. The short portion 100 is generally convexo-flat and the long portion 98 widens and heightens therefrom into a generally convexo-concave shaped handle 102. Each lever of the pair of levers 17 further has a transverse pin 104 that is integrally formed on its lower surface 106.

Figure 11:
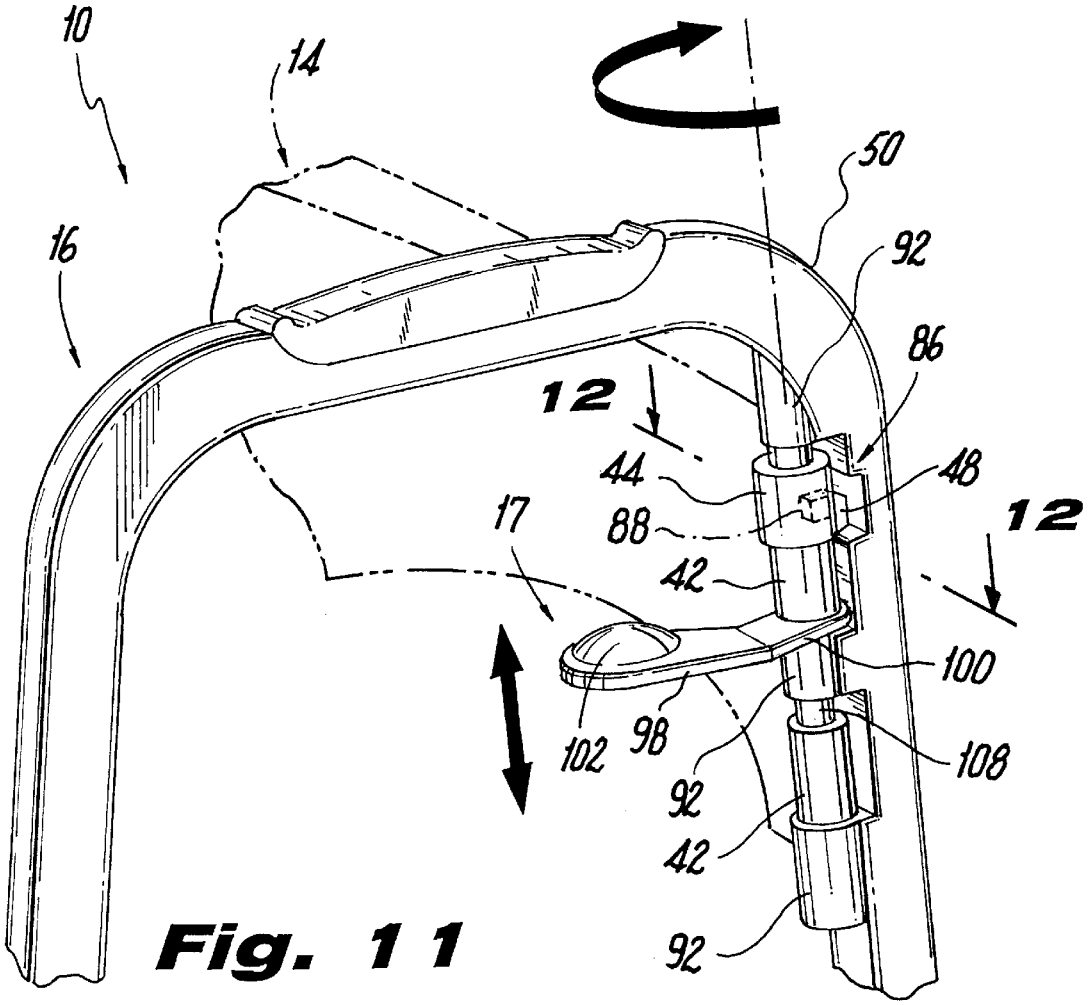
FIG. 11 is an enlarged fragmented side perspective view of the area generally enclosed by the dotted ellipse identified by Arrow 11 in FIG. 1.
Figure 12:
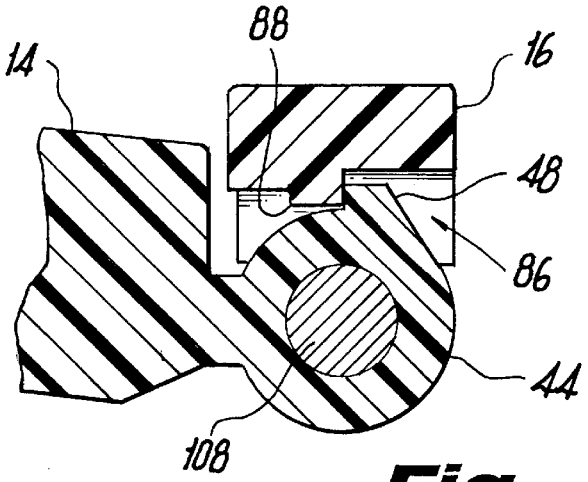
FIG. 12 is an enlarged fragmented diagrammatic cross sectional view taken on line 12—12 in FIG. 11.

The interaction of the front frame 14, the pair of side frames 16, and the pair of levers 17 can best be seen in FIGS. 11 and 12 and as such will be discussed with reference thereto.

The uppermost hinge barrel of each pair of hinge barrels of the two pair of hinge barrels 42 of the front frame 14 is pivotally disposed between the uppermost hinge barrel and the intermediate hinge barrel of the three hinge barrels 92 of the sub-frame 50 of a respective side frame of the pair of side frames 16, with the lowermost hinge barrel of each pair of hinge barrels of the two pair of hinge barrels 42 of the front frame 14 being pivotally disposed between the intermediate hinge barrel and the lowermost hinge barrel of the three hinge barrels 92 of the sub-frame 50 of the respective side frame of the pair of side frames 16, and which are maintained thereat by a hinge pin 108 that passes therethrough, and with a respective skewed surface of the pair of skewed surfaces 48 of the front frame 14 being vertically movable in the notch 86 in the sub-frame 50 of the respective side frame of the pair of side frames 16.

Each lever of the pair of levers 17 is pivotally mounted to, and extends along and above, the arm 94 of the respective side frame of the pair of side frames 16, by the transverse molded pivot 104 being snappingly received in the transverse resilient recess 96 in the arm 94, and with the short portion 100 thereof straddling the hinge pin 108 and the uppermost hinge barrel of the respective pair of hinge barrels of the two pair of hinge barrels 42 of the front frame 14 resting directly thereon.

In operation, as the collapsible walker 10 is opened, the skewed surfaces 88 in the notches 86 in the pair of side frames 16 move relative to the pair of skewed surfaces 48 of the front frame 12, until the collapsible walker 10 achieves the open position, at which time the pair of skewed surfaces 48 of the front frame 14 drop down in the notches 86 in the pair of side frames 16 and mate with, and abut against, the skewed surfaces 88 therein so as to prevent relative rotation therebetween and further rotation of the pair of side frames 16 in both directions so as to maintain the collapsible walker 10 in the locked open position.

To close the collapsible walker 10, as the long portions 98 of the pair of levers 17 are depressed, the short portions 100 thereof lift the uppermost hinge barrels of the two pair of hinges barrels 42 of the front frame 14 and their pair of skewed surfaces 48 out of engagement with the skew surfaces 88 in the notches 86 in the pair of side frames 16, and into the notches 86 in the pair of side frames 16 so as to free the pair of side frames 16 to pivot inwardly so as to allow the collapsible walker 10 to achieve the closed position.

It will be understood that each of the elements described above, or two or more together, may also find a useful application in other types of constructions differing from the types described above.

While the invention has been illustrated and described as embodied in a collapsible walker, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

I claim:

1. A collapsible walker having an open position defining an open rear adapted to have a user enter and leave therethrough and being lightweight with a strength to weight ratio sufficient to assist the user in walking when said collapsible walker is in said open position, and with said open position being automatically maintained when said collapsible walker achieves said open position, and further having a closed position where it is collapsed to reduce required storage space, said walker comprising:

a) a front frame adapted to be disposed in front of the user when said collapsible walker is in said open position, and having a pair of skewed surfaces;

b) a pair of side frames hingedly attached to opposite end edges of said front frame and being parallel to said front frame when said collapsible walker is in said closed position so as to reduce the required storage space, and being perpendicular to said front frame, and adapted to be disposed at sides of the user and supporting the user when said collapsible walker is in said open position so as to assist the user in walking; said pair of side frames having notches therein, said notches having skewed surfaces in their bottoms, said pair of skewed surfaces of said front frame being vertically movable in said notches in said pair of side frames; said skewed surfaces of said pair of side frames moving relative to said pair of skewed surfaces of said front frame as said collapsible walker is achieving said open position, until such time as said collapsible walker achieves said open position in which said pair of skewed surfaces of said front frame drop down in said notches in said pair of side frames and mate with and abut against said skewed surfaces of said side frames so as to prevent relative rotation therebetween and further rotation of said pair of side frames in both directions so as to maintain said collapsible walker in said open position; and c) a pair of levers pivotally mounted to said pair of side frames and selectively lifting said pair of skewed surfaces of said front frame out of engagement with said skewed surfaces of said pair of side frames, and into said notches in said pair of side frames so as to free said pair of side frames to pivot inwardly and allow said collapsible walker to achieve said closed position.

2. The walker as defined in claim 1, wherein said front frame includes a sheet that is vertically-oriented, planar, thin, and substantially rectangular-shaped, and has a back face adapted to face the user when said collapsible walker is in said open position, a front face disposed in front of said back face, and a periphery formed by said pair of opposite end edges, an upper edge that is longer than each end edge of said pair of end edges, and a lower edge that is disposed below said upper edge and is longer than each end edge of said pair of end edges.

3. The walker as defined in claim 2, wherein said front face of said sheet is slightly convex, said back face of said sheet is slightly concave, said upper edge of said sheet is slightly concave, and said lower edge of said sheet is slightly concave so as to prevent said front frame from interfering with the user when walking.

4. The walker as defined in claim 2, wherein said sheet of said front frame further has a plurality of throughbores that extend therethrough from said front face thereof to said back face thereof, and are quadrilateral, aligned, and spaced-apart, and are defined by peripheries.

5. The walker as defined in claim 4, wherein said front frame is formed from lightweight plastic and further includes a peripheral flange that is slender and integrally formed with, and extends continuously around, said periphery of said sheet, and slightly perpendicularly outwardly from both said front face of said sheet and said back face of said sheet so as to increase said strength to weight ratio and prevent deformation of, and premature failure of, said front frame, since said front frame is lightweight plastic.

6. The walker as defined in claim 5, wherein said front frame further includes a plurality of interior flanges, each of which is slender and integrally formed with, and extends continuously around, a respective periphery of said peripheries of said plurality of throughbores in said sheet, and slightly perpendicularly outwardly from both said front face of said sheet and said back face of said sheet so as to further increase said strength to weight ratio and provide further structural strength to further prevent the deformation of, and the premature failure of, said front frame, since said front frame is lightweight plastic.

7. The walker as defined in claim 6, wherein said front frame further includes a plurality of connecting flanges that are slender and integrally formed with, and connect, said plurality of interior flanges of said front frame to each other and to said peripheral flange of said front frame, and extend slightly perpendicularly outwardly from both said front face of said sheet and said back face of said sheet so as to still further increase the strength to weight ratio and provide still further structural strength to still further prevent the deformation of, and the premature failure of, said front frame, since said front frame is lightweight plastic.

8. The walker as defined in claim 5, wherein said front frame further includes two pair of hinge barrels, each pair of which is vertically-aligned, integrally formed with, and extends from, said peripheral flange of said front frame, at a respective end edge of said pair of end edges of said sheet.

9. The walker as defined in claim 8, wherein each uppermost hinge barrel of said two pair of hinge barrels of said front frame is widened at its top to form a widened portion that has extending perpendicularly forwardly therefrom, and integrally therewith, a projection that is horizontally-oriented and substantially right-triangular-shaped, with its hypothenuse extending from said widened portion forwardly inwardly towards said front face of said sheet and forming a respective skewed surface of said pair of skewed surfaces of said front frame, with said pair of skewed surfaces of said front frame being horizontally-oriented, and with said widened top portion being widened to better adsorb load on said projection when said walker is in said open position and being used.

10. The walker as defined in claim 9, wherein each side frame of said pair of side frames includes a sub-frame that is lightweight plastic with flanges to further increase said strength to weight ratio, and is vertically-oriented and substantially A-shaped, and includes:

a) an upper cross member that is slender, elongated, and horizontally-oriented, and has a pair of ends, and a recess in its top face for receiving a hand grip that is adapted to be gripped by the user when walking;

b) a front leg that has a hollow bottom with a stop therein, and is slender, elongated, and extends slightly forwardly downwardly from, and is integrally formed at its top to, a forwardmost end of said pair of ends of said upper cross member;

c) a rear leg that has a hollow bottom with a stop therein, and is slender, elongated, and extends slightly rearwardly downwardly from, and is integrally formed at its top to, a rearmost end of said pair of ends of said upper cross member, and is disposed in back of, and coplanarly with, said front leg; and d) a lower cross member that is horizontally-oriented, slender, and elongated, and disposed below, and parallel to, said upper cross member, and is integrally formed with, and connected at its ends to, said front leg and to said back leg, at an elevation just above their hollow bottoms, and forms with said front leg, said back leg, and said upper cross member a quadrilateral.

11. The walker as defined in claim 10, wherein each of said front leg and said rear leg contains an upper leg element that is tubular and extends collinearly from their stops outwardly through their hollow bottoms.

12. The walker as defined in claim 11, wherein each of said front leg and said rear leg further has a lower leg element that is tubular and extends collinearly and telescopically from said upper leg element so as to be height adjustable, and terminates in a resilient tip so as to increase traction.

13. The walker as defined in claim 10, wherein said front leg further has an inner face that faces the rear leg, and a respective notch of said pair of notches is disposed at a top of said inner face of said front leg, with said respective notch being vertically-oriented, and three hinge barrels that are vertically-aligned, with an uppermost hinge barrel thereof and an intermediate hinge barrel thereof straddling said respective notch therebetween; said uppermost hinge barrel of said three hinge barrels is disposed at the top of the front leg and a lowermost hinge barrel thereof is disposed between said intermediate hinge barrel and said lower cross member.

14. The walker as defined in claim 13, wherein said inner face of said front leg further has an arm that is perpendicular to, and integral with, said intermediate hinge barrel, and extends towards said back leg to a distance past said three hinge barrels, and terminates in a transverse resilient recess that is upwardly opening.

15. The walker as defined in claim 14, wherein said uppermost hinge barrel of each pair of hinge barrels of said two pair of hinge barrels of said front frame is pivotally disposed between said uppermost hinge barrel and said intermediate hinge barrel of said three hinge barrels of a respective side frame of said pair of side frames, with said lowermost hinge barrel of each pair of hinge barrels of said two pair of hinge barrels of said front frame being pivotally disposed between said intermediate hinge barrel and said lowermost hinge barrel of said three hinge barrels of said respective side frame, and being maintained thereat by a hinge pin that passes therethrough.

16. The walker as defined in claim 15, wherein each lever of said pair of levers has a long portion and a short portion that is integrally formed with, and shorter than, said long portion and is bifurcated and straddles a respective hinge pin, with said uppermost hinge barrel of a respective pair of hinge barrels of said two pair of hinge barrels of said front frame resting directly thereon; said short portion of each lever lifts a respective skewed surface of said pair of skewed surfaces of said front frame out of engagement with a respective skewed surface of said skewed surfaces of said pair of side frames when said long portion of said lever is depressed.

17. The walker as defined in claim 16, wherein said short portion of each lever of said pair of is generally convexo-flat and said long portion thereof widens and heightens therefrom into a generally convexo-concave shaped handle; each lever of said pair of levers further has a transverse pin integrally formed on its lower surface and which is snappingly received in said transverse resilient recess in said arm of said respective side frame of said pair of side frames.

* * * * *